US010273057B2

(12) United States Patent
Freulon et al.

(10) Patent No.: US 10,273,057 B2
(45) Date of Patent: Apr. 30, 2019

(54) CLOSURE DEVICE WITH HOOKS IN HOOKS HAVING A SENSORY EFFECT

(71) Applicant: APLIX, Le Cellier (FR)

(72) Inventors: Arnaud Thierry Jean-Marie Freulon, Les Sorinières (FR); Anthony Bertrand Patrick Mahe, Pont Saint-Martin (FR)

(73) Assignee: APLIX, Le Cellier (FR)

( * ) Notice: Subject to any disclaimer, the term of this patent is extended or adjusted under 35 U.S.C. 154(b) by 28 days.

(21) Appl. No.: 15/520,699

(22) PCT Filed: Oct. 27, 2015

(86) PCT No.: PCT/EP2015/074894

§ 371 (c)(1),
(2) Date: Apr. 20, 2017

(87) PCT Pub. No.: WO2016/066649

PCT Pub. Date: May 6, 2016

(65) Prior Publication Data

US 2017/0305608 A1 Oct. 26, 2017

(30) Foreign Application Priority Data

Oct. 31, 2014 (FR) ..... 14 02467

(51) Int. Cl.

| | |
|---|---|
| ***B65D 33/24*** | (2006.01) |
| ***A44B 18/00*** | (2006.01) |
| ***B65D 33/25*** | (2006.01) |

(52) U.S. Cl.
CPC ..... *B65D 33/24* (2013.01); *A44B 18/0007* (2013.01); *A44B 18/0015* (2013.01); *B65D 33/25* (2013.01)

(58) Field of Classification Search
CPC .... B65D 33/24; B65D 33/25; A44B 18/0007; A44B 18/0015; Y10T 24/2792
See application file for complete search history.

(56) References Cited

U.S. PATENT DOCUMENTS

| | | | | |
|---|---|---|---|---|
| 5,067,210 | A * | 11/1991 | Keyaki | A44B 18/0053 24/442 |
| 5,119,531 | A * | 6/1992 | Berger | A44B 18/0053 24/452 |
| 7,246,416 | B2 * | 7/2007 | Duffy | A44B 18/0049 24/444 |
| 2004/0170801 | A1 * | 9/2004 | Seth | A44B 18/0053 428/100 |
| 2004/0187276 | A1 * | 9/2004 | Seth | A44B 18/0065 24/452 |
| 2010/0135600 | A1 | 6/2010 | Ducauchuis et al. | |

FOREIGN PATENT DOCUMENTS

WO WO 2012/073999 A1 6/2012

* cited by examiner

*Primary Examiner* — Robert Sandy
(74) *Attorney, Agent, or Firm* — Renner Kenner Greive Bobak Taylor & Weber

(57) ABSTRACT

Device for closing the opening of a sack, in particular a sack made of flexible material, including a first element with hooks and a second element with hooks, the hooks (9) of the two elements engaging into one another to achieve the closure of the opening, each element with hooks including a base strip (7, 8) and hooks coming from the strip.

19 Claims, 6 Drawing Sheets

FIG.6
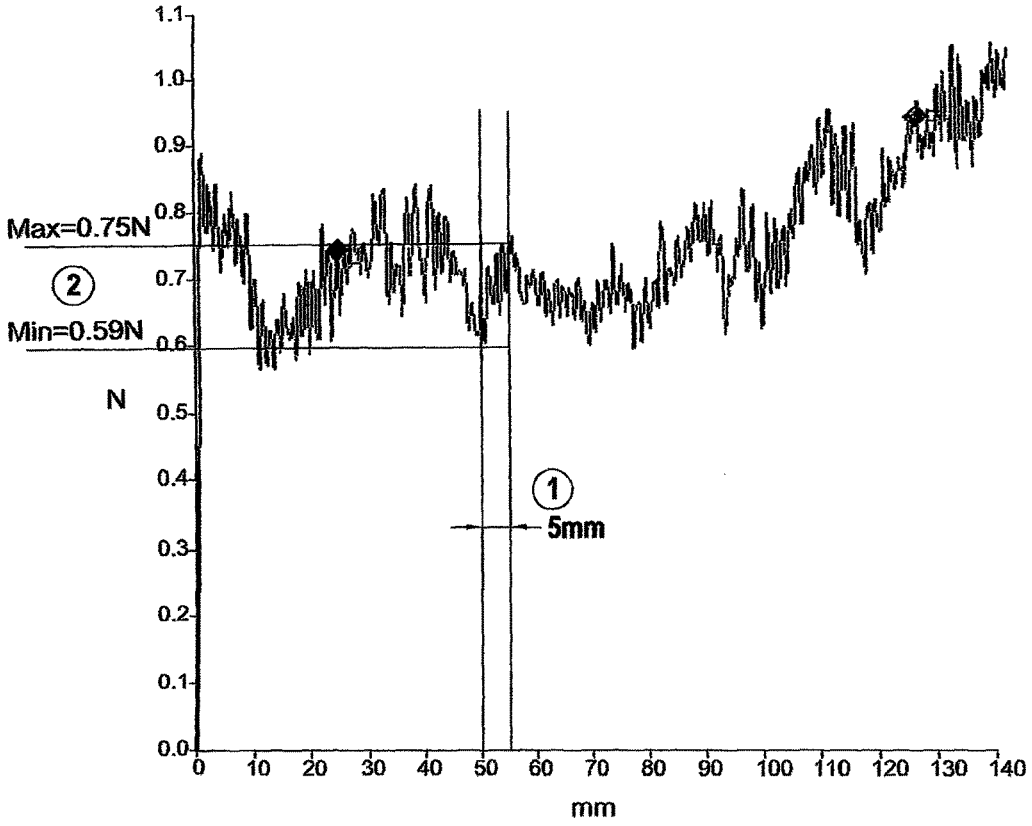
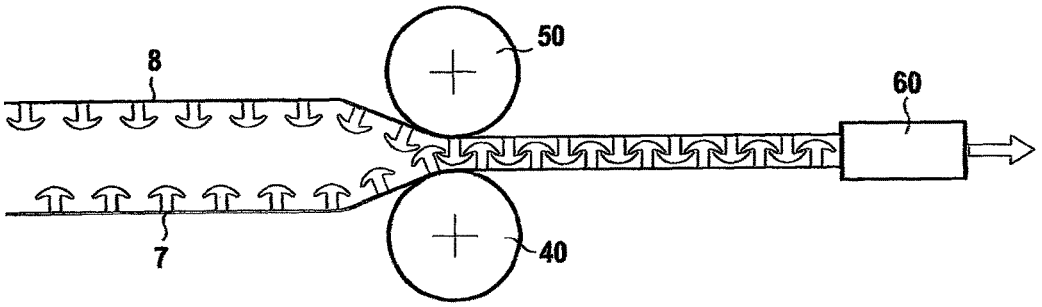
FIG.7

CLOSURE DEVICE WITH HOOKS IN HOOKS HAVING A SENSORY EFFECT

TECHNICAL DOMAIN

The present invention relates to a bag, in particular a bag made of flexible material, having an opening and comprising a self-gripping closure device referred to as having hooks in hooks, comprising a first element formed by a first base strip and first hooks that protrude from this first base strip and by a second element formed by a second base strip and second hooks that protrude from the second base strip, the first and second hooks engaging into one another to achieve the closure of the opening. The present invention also relates to a self-gripping closure device of this type intended for a bag.

BACKGROUND TO THE INVENTION

Already known from the prior art are bags that comprise self-gripping closures with hooks in hooks, in particular from European Patent 2 157 878 in the name of the Applicant.

The self-gripping closure devices that are described have the advantage of offering a high degree of flexibility to the closure, and this makes them particularly well adapted to flexible bags.

However, these closure devices from the prior art are associated with the disadvantage that when he closes the bag by squeezing the closure device between two fingers and sliding them along the closure, the user is not given any sensory feedback as regards correct closure of the bag, and he may be given the impression that the bag has not been correctly closed.

Furthermore, once the system has been closed between his fingers, the user must close the rest of the bag by sliding his fingers transversely along the closure. However, the zip-type products from the prior art do not give any signal that indicates that the bag is still closed, the closure force during sliding being almost constant all along the closure and identical whether the bag is closed or not, a certain number of situations even being able to cause a zip closure system to leave its rails: pollution, poorly positioned food, bad positioning relative to the two facing strips, etc. As a result, it is extremely desirable for the user to be able to feel that he is always closing the bag correctly, not only while squeezing, but also during the sliding motion.

OBJECT AND SUMMARY OF THE INVENTION

The objective of the present invention is to make available a closure device for a bag of the type specified above which, while being easy to produce and retaining excellent flexibility, enabling, if so desired, perfect adaptation to flexible bags, furthermore provides the user with sensory feedback as regards the closure of the bag, and in particular assurance that the bag has been correctly closed, in particular by squeezing it between two fingers as well as during the sliding motion to close the rest of the bag.

According to the invention, a device for closing the opening of a bag, in particular made of flexible material, is as defined in Claim 1, the sub-claims defining advantageous improvements and/or preferred embodiments.

By thus providing this attribute of the closure device (force curve dependent upon movement), one obtains for the user an excellent sensation during closure of the closure device, in particular in the form of a type of "click" assuring him or her that the closure device has indeed been closed.

According to one preferred embodiment of the invention, at least one of the elements with hooks comprises hooks coming from a base strip, each hook comprising a part that forms a stem and a part that forms a head that protrudes laterally from the part forming the stem, and the arrangement is such that when the two elements engage into one another, the uppermost point of the head of each hook of said at least one of the hooking elements remains a given distance away from the base strip of the other element with hooks.

According to one preferred embodiment of the invention, the ratio of the given distance e to the height h of the stem is between 10% and 70%, in particular between 20% and 50%.

According to one particularly preferred embodiment of the invention, the two elements with hooks each comprise a base strip and hooks coming from the respective base strip, each element with hooks comprising a part that forms a stem and a part that forms a head that protrudes laterally from the part forming the stem and, when the bag is closed, the uppermost point of each hook of one of the elements with hooks remains a distance away from the base strip of the other element with hooks, and vice versa.

Preferably, the hooks of at least one of the two elements with hooks, in particular of the two elements with hooks, are arranged in a plurality of rows, and the distance between two adjacent hooks along a row is greater than or equal to the respective dimension of the hooks measured along said row.

According to one preferred embodiment of the invention, the hooks of at least one element with hooks are identical to one another.

According to one preferred embodiment of the invention, the hooks of the two elements with hooks are identical to one another.

According to one preferred embodiment of the invention, each hook comprises two hooking parts, left and right, in the form of wings that protrude laterally from a stem.

Preferably, the hooks are arranged in a plurality of rows, and the hooking parts in the form of wings extend in a transverse direction relative to the direction of the rows respectively in the opposing right and left directions.

According to one preferred embodiment of the invention, the hooks are arranged in a plurality of rows, and each hook of at least one element, in particular of the two elements, is delimited over its whole height, i.e. from the base strip to its summit, by two planar surfaces that are mutually opposing transverse to the direction of the at least one row of hooks, the two planar surfaces being formed in particular by a cut-out.

According to another embodiment of the invention, one of the two elements with hooks comprises a rail comprising a base part and a lateral hooking part which extend over a whole row.

BRIEF DESCRIPTION OF THE DRAWINGS

As an example, preferred embodiments of the invention will now be described with reference to the drawings in which:

FIG. 6 shows the curve obtained that gives the traction force provided by a traction structure when one pulls with this structure a closure according to the invention in order to bring it into a gap between two rollers so as to thus simulate closure by sliding along the closure;

FIG. 7 is a diagram representing a piece of equipment with a roller and a traction structure used to obtain the curve of FIG. 6.

DETAILED DESCRIPTION OF EMBODIMENTS

Figure 1:
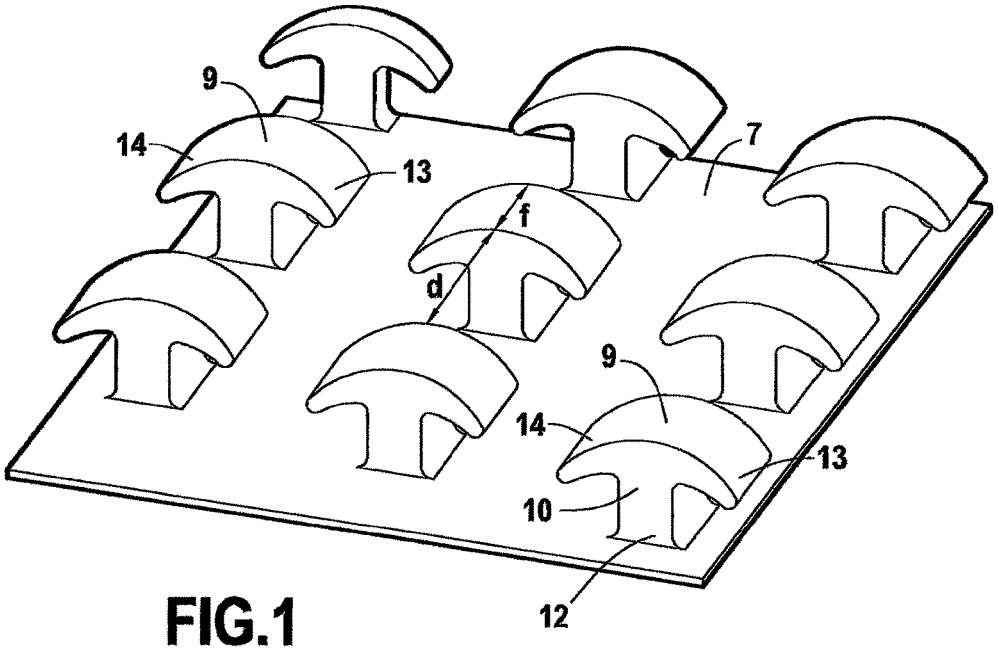
FIG. 1 is a perspective top view of part of an element with hooks intended to engage into another element with hooks, in particular an identical element, so as to form a closure device according to the invention.
Figure 2:
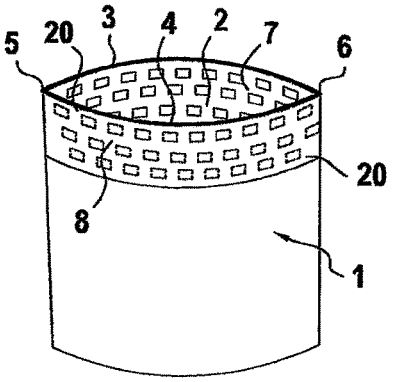
FIG. 2 is a perspective view of a flexible bag made of plastic material and comprising an opening provided with a self-gripping closure device that comprises two elements with hooks as described in FIG. 1, the hooks of which are arranged in a plurality of rows and face one another for its closure.

In FIG. 2, a plastic bag 1 comprises an opening 2 delimited by a first edge 3 and a second edge 4 that join at a first end point 5 and a second end point 6. Each of the edges 3 and 4 respectively comprises respective strips 7 and 8 with hooks, which strips are fixed in particular by adhesion or any other means (thermal welding or similar, etc.), like those shown in FIG. 1. Each strip is made up of a central part with hooks, delimited on either side by two longitudinal border parts 20. However, one can also provide just one border with just one side or even no border.

The strips 7 and 8 with hooks are made of a traditional thermoplastic material such as polyethylene, polypropylene, polyester, or of a biodegradable material such as PBS, PLA, etc. They each comprise a plurality of hooks 9, each delimited by two lateral surfaces 11 and 12, and each comprising a stem 10 that has a substantially rectangular parallelepipedic form. The hooks are arranged in rows that are parallel to one another. The lateral surfaces 11 and 12 extend here perpendicular to the direction of extension of the rows. They could also be inclined, for example at an angle $\alpha$ of 1 to 35° in relation to the perpendicular to the direction of the rows, as in a version shown in FIG. 8. In this version of FIG. 8, provision is also made such that the hooks of one row are slightly offset in the direction perpendicular to the direction of the rows in relation to the hooks of the adjacent row, in particular by a distance Q of between 0.1 mm and 0.7 mm, more specifically between 0.2 mm and 0.5 mm.

The distance between two successive hooks in a row is greater than or equal to the thickness of each hook measured in this same row direction. In particular, the two lateral surfaces 11 and 12 are planar, corresponding to the fact that they were formed using a knife according to the process that is well known in the field and called the De Navas or Repla process that is described, for example, in American Patent U.S. Pat. No. 4,056,593. The head and the stem of each hook are both delimited on either side by these two planar lateral surfaces. However, one could produce the hooks in a different way, and in particular one could form mushrooms or hooks with a simple head in their place.

Two, left and right, extension parts that form hook wings 13 and 14 protrude laterally on either side in the direction perpendicular to the direction of the rows of the summit part of the stem 10. These wings 13 and 14 form the hooking part of the hook. In each row the hooks are arranged a distance apart from one another. This distance between hooks, measured by the distance at the level of the base strip of the stem between the respectively mutually facing planar lateral surfaces 11 and 12 of a hook and of its immediate neighbor in the same row, is measured along the direction of the row and is designated by d. Here this distance d is, for example, greater than or equal to f, the thickness of the hook.

Figure 3:
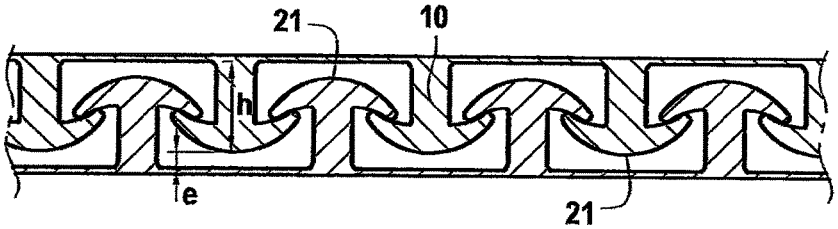
FIG. 3 is a cross-sectional view showing the interaction between the hooks of the two elements with hooks when closing the bag of FIG. 2.
Figure 4B:
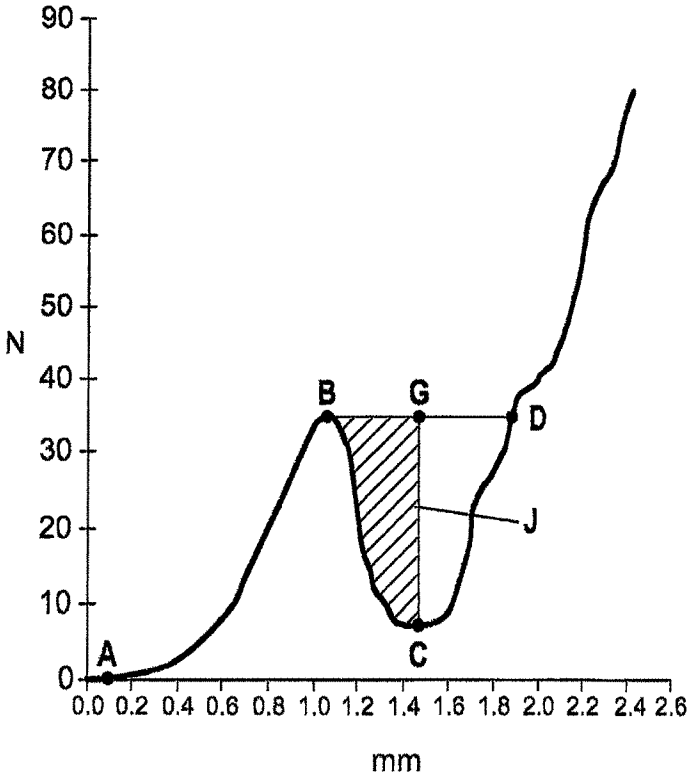
FIG. 4B shows for a closure device with hooks of the type shown in FIGS. 1 to 3 when positioned between two structures, one of which is immobile, and the other of which is mobile, the curve giving the compressive force applied to the closure device as a function of the movement of the mobile structure in the direction of the fixed or immobile structure.
Figure 4A:
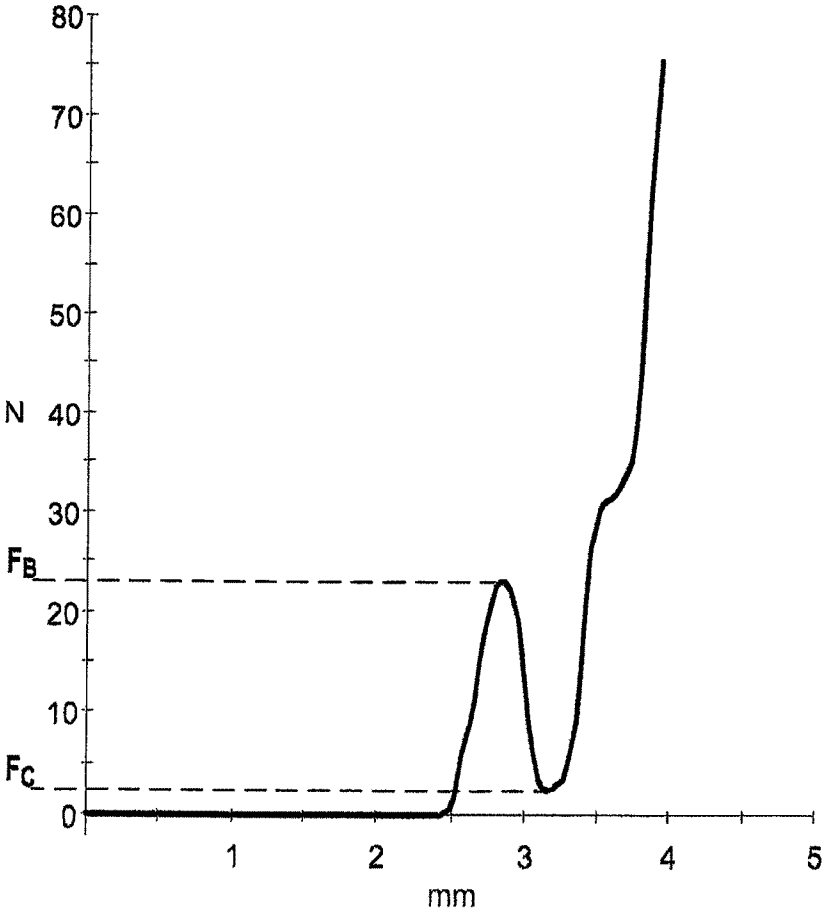
FIG. 4A shows, for a closure device with hooks of the type shown in FIGS. 1 to 3 when positioned between two assemblies, one of which is immobile, and the other of which is mobile, the curve giving the compressive force applied to the closure device as a function of the movement of the mobile structure in the direction of the fixed structure (also called an immobile structure)
Figure 4C:
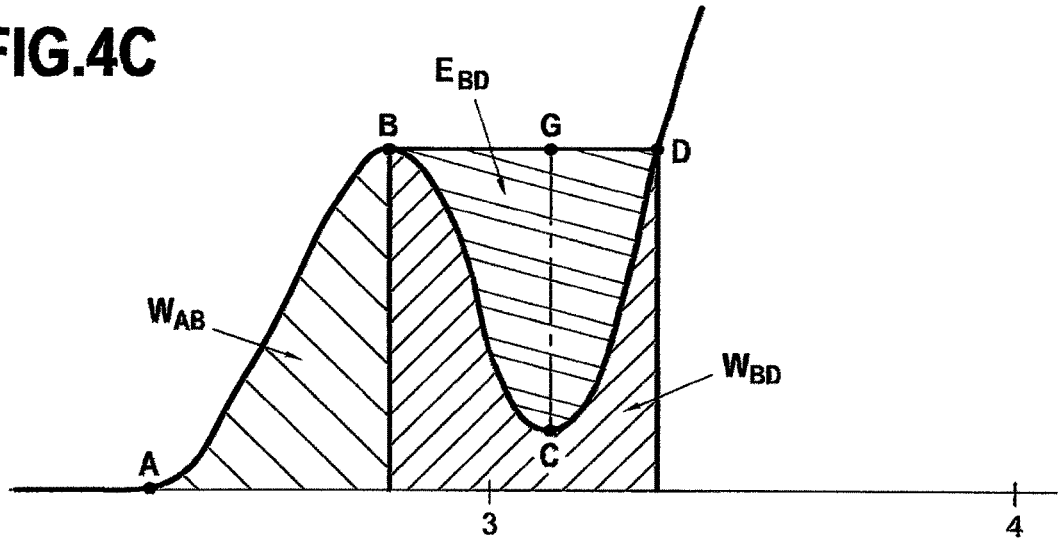
FIG. 4C shows in more detail a part of the curve of FIG. 4A.
Figure 4D:
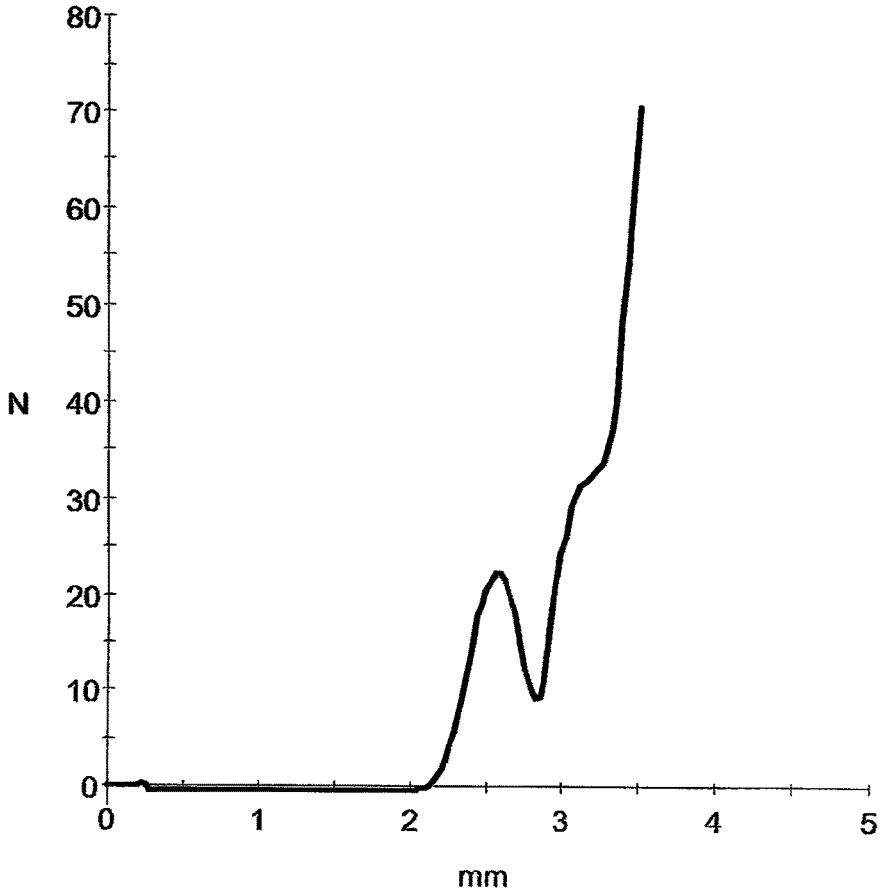
FIG. 4D shows, for a closure device with hooks from the prior art, in particular as described in EP-A-2157878, when positioned between two structures, one of which is immobile, and the other of which is mobile, the curve giving the compressive force applied to the closure device as a function of the movement of the mobile structure in the direction of the fixed structure.

As can be seen in FIG. 3, the uppermost point 21 of the hooks of the strip 7 with hooks, when the hooks engage into one another with the hooks of the other strip 8 with hooks, is located a distance e other than zero away from the base of the other base strip 8. Likewise, the uppermost point 21 (lower in the figure) of the hooks of the strip 8 with hooks is located a distance other than zero away from the base of the base strip 7, in particular the same distance e other than zero.

In particular, the dimensions of the hooks can be as follows:

The thickness f can be between 0.1 mm and 2.0 mm, more specifically between 0.2 mm and 0.65 mm.

The height h can be between 0.4 mm and 1.5 mm, more specifically between 0.9 mm and 1.3 mm, preferably about 1 mm or even more preferably about 1.1 mm.

Thus, in the closed state (FIG. 3 or 8), the distance between the uppermost point of the head and the opposing base strip can be between 0.2 mm and 0.4 mm, or else as a percentage of the height of the hooks, between 10% and 70%, in particular between 20% and 50%.

The thicknesses of the base bands can be between 0.07 mm and 1 mm, in particular less than 0.5 mm and preferably about 0.1 mm.

The density of the hooks can be between 10 and 500 hooks/cm$^2$, in particular between 50 and 250 hooks/cm$^2$.

The following test is carried out on the closure of FIG. 3 that comprises the two strips with hooks 7 and 8. The two strips 7 and 8 are respectively fixed (on the side without hooks) to an immobile structure and to a mobile structure facing one another, for example by adhesion, in order to prevent the two strips or ribbons from slipping, for example by using a double-sided adhesive tape.

Figure 5A:
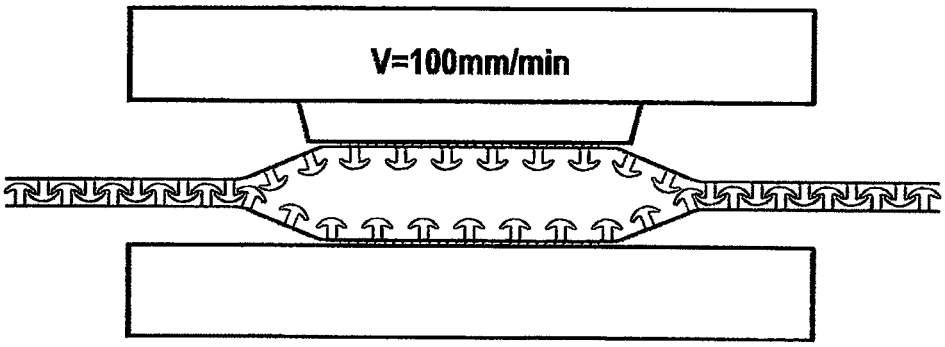
FIGS. 5A and 5B are diagrams representing a structure mechanism and a closure device according to the invention arranged between the structures so as to execute the measures required to trace the curve of FIGS. 4A to 4D.
Figure 5B:
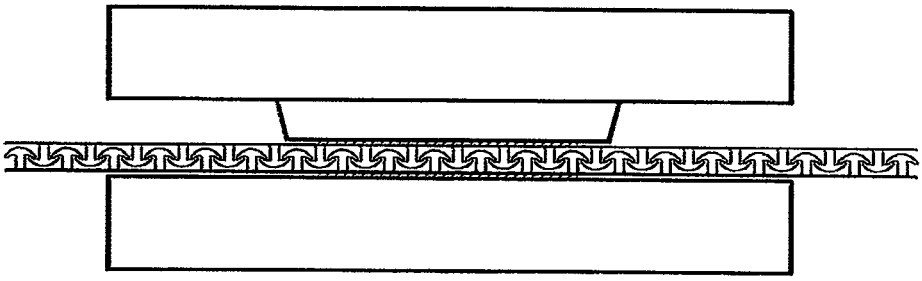

In the initial position of the structures and of the ribbons, it is ensured that the hooks of the two ribbons with hooks are engaged or clipped into one another on the end parts, whereas on a central part that has an extension substantially equal to the extension with the width of the useful compressive part of the mobile structure, they are a distance apart from one another (see FIG. 5A).

The mobile structure is then moved towards the immobile structure, in particular at a speed of approximately 100 mm/min. In the course of this movement of the mobile structure one measures the compressive force applied to the closure formed by the two ribbons as a function of the movement by means of a 100 N dynamometric cell with which, for example, the mobile structure is equipped.

A curve as shown in FIG. 4A, 4B, 4C or 4D is obtained in which the horizontal axis indicates movement in millimeters (mm) and the vertical axis indicates a force in Newtons (N). This curve rises from a point A to a point B, forming a first local maximum that corresponds to the point where the heads of the hooks of the integral strip of the mobile structure pass beyond the heads of the hooks of the other integral strip of the lower immobile structure. The curve then falls to a local minimum C that corresponds to the time at which the upper point of the heads of the hooks of the upper ribbon comes into contact with the bottom of the opposing counterpart. The curve then rises, corresponding to the two strips being squashed against one another. It should be noted that the abscissa from which the curve starts to rise from zero is variable as a function of the initial separation of the mobile and immobile structures. Thus, in order to produce FIGS. 4A, 4C and 4D, the operator started from a larger initial separation between the structures than in order to produce FIG. 4B. However, the form of the curve from the point where it starts to rise is identical and is not dependent upon this initial separation, nor upon the abscissa of this starting point.

When the user initiates the closure operation, he places the two strips in contact with one another and applies pressure to bring about closure. According to the invention a closure is obtained that provides the user with sensory feedback regarding the fact that the closure is in place and ready to be closed. This is a definite advantage because this prevents immediate closure that in certain cases makes it necessary to re-open the packaging when the closure is an unsuitable position. Furthermore, according to the present invention this feature contributes to a large extent to the quality of the closure perceived by the user. This feature corresponds to the gently sloping section AB of the compression curve of FIGS. 4A to 4C, the whole of the closure system being balanced. The appearance of this feature has been enabled by a specific system design. The closure is composed of a plurality of elements that are independent of one another and that have sufficient flexibility in order to reposition themselves in relation to one another.

A user of a closure needs to feel that the closure has indeed taken place so as to be reassured concerning the effectiveness of the closure. The inventors have therefore sought to create a specific sensation for the user in the form of a "click" effect—a "click" that is not heard, but that is felt.

In order to create a characteristic click, it has been observed that a zone J (delimited at the top by the horizontal straight line passing via B, i.e. the segment BG, on the right-hand side by the vertical segment GC and beneath by the curve itself) must have the largest possible surface area, this surface area corresponding to a loss of energy in Force X movement, (or "work" according to the term from physics, in N·mm). The latter is generally greater than 0.1 N·mm, preferably greater than 1 N·mm and even more specifically greater than 10 N·mm. More specifically, it is less than 1000 N·mm. This corresponds to the closure sensation perceived by the user.

Preferably, the inventors of the present invention have understood that a zone (delimited at the top by the horizontal segment BD and beneath by the curve itself) should have the largest possible surface area $E_{BD}$, in relation to the surface area $W_{AB}$ beneath the curve between points A and B, namely $E_{BD}$ must be greater than 0.70 times $W_{AB}$, especially greater than 0.75 times $W_{AB}$, especially greater than 0.80 times $W_{AB}$, especially greater than 0.85 times $W_{AB}$, especially greater than 0.90 times $W_{AB}$, especially greater than 0.95 times $W_{AB}$, especially greater than 1.00 times $W_{AB}$, especially greater than 1.05 times $W_{AB}$, especially greater than 1.10 times $W_{AB}$, especially greater than 1.15 times $W_{AB}$, especially greater than 1.20 times $W_{AB}$, especially greater than 1.25 times $W_{AB}$, especially greater than 1.30 times $W_{AB}$, especially greater than 1.35 times $W_{AB}$, especially greater than 1.40 times $W_{AB}$, especially greater than 1.45 times $W_{AB}$, especially greater than 1.50 times $W_{AB}$. In particular, $E_{BD}$ is equal to approximately 1.3 times $W_{AB}$.

In the present application work $W_{AB}$ or Energy AB designates the surface area delimited by the horizontal axis, the curve and the two vertical straight lines passing via the abscissas of points A and B.

The surface area $E_{BD}$, or Energy BD, corresponds to an energy well (in Force X movement, or "work" according to the term from physics, in N·mm). The latter is generally greater than 0.1 N·mm, preferably greater than 1 N·mm and even more specifically greater than 10 N·mm. More specifically, it is less than 1000 N·mm. This corresponds to the closure sensation perceived by the user.

This "virtual" energy BD corresponds to the difference of the energy that would have been supplied passing from point B to point D at constant force, less the actual energy provided from point B to point D. In order to increase this energy well, the inventors have worked on increasing distance B-D, in particular distance B-G, by playing in particular on the relative height of the hooks in relation to the distance between the two strips in the closure state.

Some intervals relating to this curve:

- Point A is the point at the far left of the curve from which the force becomes non-zero.
- Force $F_B$ at point B is generally between 10 N and 35 N, more specifically between 15 N and 25 N and in particular between 17 N and 23 N, and is generally about 20 N. Force $F_A$ at point A is less than force $F_B$ at point B for the same curve.
- Force $F_c$ at point C is generally between 0.1 N and 30 N, more specifically between 1 N and 15 N, in particular between 4 N and 10 N, for example it can be equal to 8 N and in particular can be less than 7 N, more specifically less than 5 N. Force $F_c$ at point C is less than force $F_B$ at point B for the same curve. Point C is the point of which the force is minimal at the far right of the curve. It is also the first local minimum after point B.
- The distance between points A and D is generally between 0.1 mm and 4 mm, more specifically about 1.5 mm.
- The value of the projection of segment BD along the horizontal axis is less than the value of the projection of segment AD along the horizontal axis.
- The value of the projection of segment AB along the horizontal axis is generally less than or equal to 2.5 mm, more specifically less than or equal to 1.5 mm, and in some cases greater than 0.3 mm and more specifically greater than 0.5 mm.

The value of the projection of segment BD is greater than 0.45 mm, in particular greater than 0.50 mm, and preferably less than 2.00 mm, for example it is equal to 0.57 mm.

On the other hand, preferably, force $F_B$ of the curve at point B is greater than 2 times force $F_c$ of the curve at point C, in particular greater than 3 times force $F_c$, in particular greater than 4 times force $F_c$, in particular greater than 5 times force $F_c$.

The "click" coefficient is defined according to the following formula:

"Click" coefficient=(value of the force at point $B)^2$/(value of the projection of segment $AB$ over the horizontal axis)

A "good" "click" coefficient is preferably greater than or equal to 100 $N^2$/mm, more specifically greater than or equal to 150 $N^2$/mm and/or in some cases less than or equal to 700 $N^2$/mm, more specifically less than or equal to 500 $N^2$/mm.

On the other hand, according to the invention the user can receive sensory feedback from the bag when he slides his fingers along the closure in order to close the latter, it thus being assured that he will always close the bag.

This advantage of the closure according to the invention is highlighted in FIG. 6.

Figure 8:
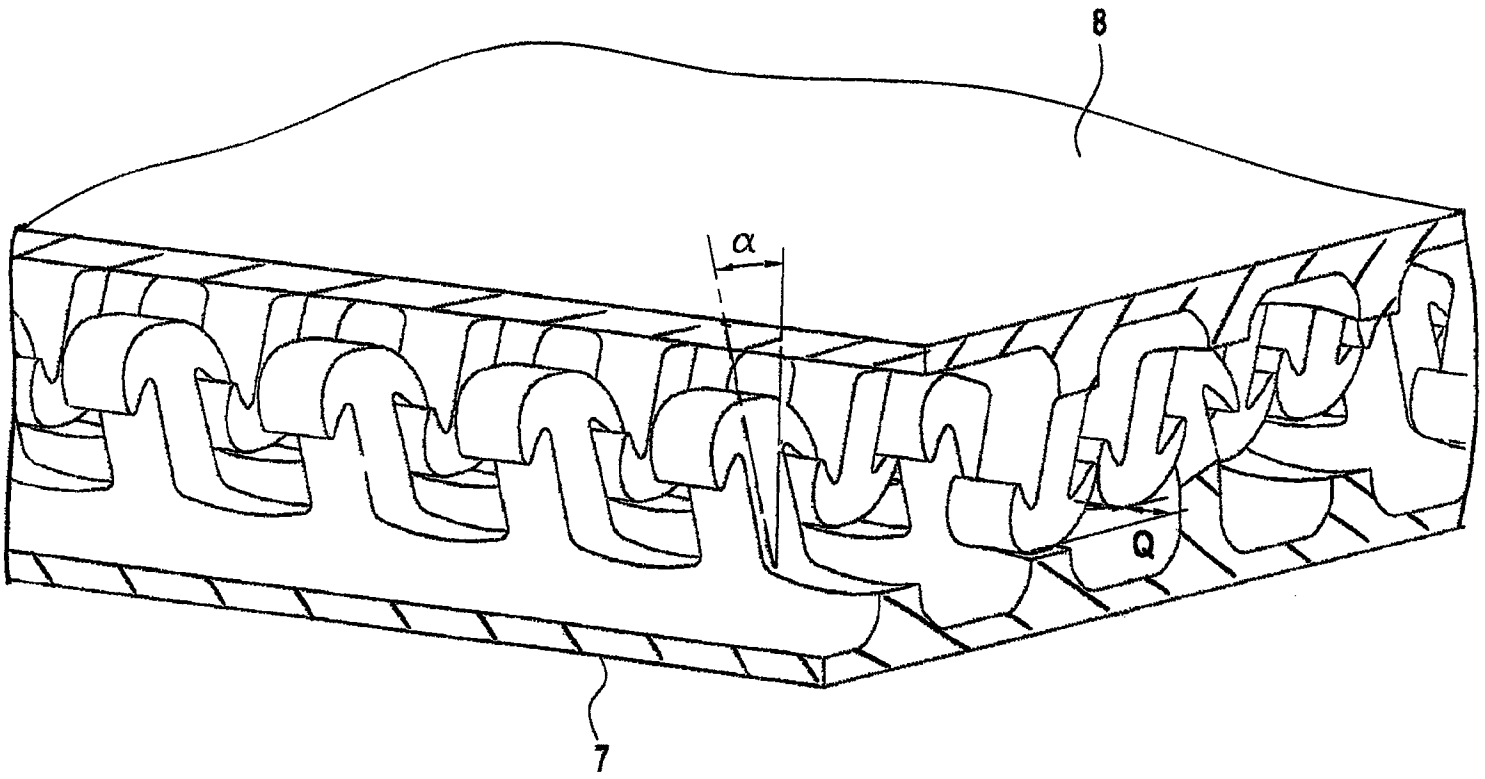
FIG. 8 is a perspective and cross-sectional view showing the interaction between the hooks of two elements with hooks during the closure of the bag according to another embodiment.

In order to obtain the curve of FIG. 6, one takes two ribbons with hooks according to the invention, for example as shown in FIGS. 1 to 3, with a length of 25 cm, 5 cm of which are already engaged in one another and are inserted into a gap between two rollers 40 and 50. The dimension of the gap corresponds substantially to the dimension of the closure in the engaged state of the hooks. Engaged is understood to mean that locally the majority of the heads of the hooks of one of the ribbons are co-operating, as shown in FIG. 3 or FIG. 8, with one or more of the heads of the hooks of the other ribbon. In other words, locally the majority of the heads of the hooks of one of the ribbons are located between the heads of the hooks of the other of the ribbons and the base of the other of the ribbons.

A traction structure 60 is arranged such as to pull the closure upwards so that when it is pulled, the remainder of the two ribbons is passed between the two rollers so that their hooks engage into one another. The force applied is measured dependently upon the movement of the traction structure. This force is measured with the aid of a 10 N dynamometric cell with which the traction structure is equipped.

Contrary to the prior art where an almost constant force was obtained during the whole closure process, the product according to the invention is characterized by a variable signal, as shown in FIG. 6, that makes it possible to send a sensory signal to the user showing that the bag is indeed in the process of being closed. This signal is characterized by a closure frequency that is characterized by a signal period, in mm, and an amplitude.

In step No. 1 an interval of 5 mm is taken which corresponds to that representative of the sensitivity of a user who wishes to close this type of closure.

In step No. 2, the maximum (0.75 N) and the minimum (0.59 N) in this interval are identified.

In step No. 3, the average (0.67 N) is calculated using the aforementioned maximum and minimum.

The amplitude of the sensory signal defined by the ratio of the aforementioned Maximum to the aforementioned Average is then calculated. Here one obtains 11%.

Preferably, this method will be performed a number of times, preferably three times, such as to obtain an average of this sensory signal amplitude.

In general, the amplitude of the signal is greater than 2%, more specifically greater than 4%, more specifically greater than 10%, and in some cases less than 50%.

A specific application of the invention is in the food sector or else in the domain of stoma.

The invention claimed is:

1. A device for closing an opening of a bag, especially a bag made of flexible material, comprising on a one hand a first element with hooks, and on a other hand a second element with hooks, the hooks of the two elements engaging into one another to achieve the closure of the opening, each element with hooks comprising a base strip and hooks extending from the strip, characterized in that the material or materials and/or the dimension or dimensions of the elements with hooks is/are chosen such that when the two elements with hooks are positioned with their respective hooks facing one another between an immobile structure and a mobile structure moving towards the immobile structure in order to compress the hooks of the two elements with hooks into one another, and a curve giving a compressive force applied by the mobile structure as a function of the movement of the mobile structure is traced, such that a curve is obtained that has a section that rises to a first local maximum (B), and next a section then falling to a local minimum (C), after which there is once again a rising section, and an energy well $E_{BD}$, equal to a product of force $F_B$ at the first local maximum (B) times a distance (BD) of the first local maximum (B) at a point (D) of intersection of the curve with a horizontal straight line passing via the first local maximum (B), less a work $W_{BD}$, i.e. $((F_B \times BD)-W_{BD})$ is greater than 0.7 times a work provided $W_{AB}$ by the mobile structure between a point (A) from which the force starts to rise to the first local maximum (B).

2. The device according to claim 1, characterized in that the energy well $E_{BD}$ is 1.00 times greater than the work provided $W_{AB}$ by the mobile structure between a point (A) from which the force starts to increase to the first local maximum (B).

3. The device according to claim 1, characterized in that the distance (BD) from the first local maximum (B) to the intersection point (D) of the curve with the horizontal straight line passing via the first local maximum (B) is greater than 0.45 mm.

4. The device according to claim 3, characterized in that the distance (BD) from the first local maximum (B) to the point (D) of intersection of the curve with the horizontal straight line passing via the first local maximum (B) is between 0.5 mm and 2.0 mm.

5. The device according to claim 1, characterized in that a force ($F_B$) of the curve at the first local maximum (B) is greater than two times a force ($F_e$) of the curve at the local minimum (C).

6. The device according to claim 5, characterized in that the force ($F_B$) of the curve at the first local maximum (B) is greater than five times the force ($F_C$) of the curve at the local minimum (C).

7. The device according to claim 1, characterized in that a force ($F_c$) is less than 7N.

8. The device according to claim 7, characterized in that the force ($F_c$) is less than 5N.

9. The device according to claim 1, characterized in that a absolute value of the slope of a straight line (AB) passing from point (A) from which the force starts to increase to the first local maximum (B) is strictly less than an absolute value of the slope of a straight line (BC) passing from the first local maximum (B) to the local minimum (C).

10. The device according to claim 1, characterized in that at least one of the elements with hooks comprises hooks extending from a base strip, each hook comprising a part that forms a stem and a part that forms a head that protrudes laterally from the part forming the stem, and an arrangement is such that when the two elements engage into one another, the uppermost point of the head of each hook of said at least one of the hooking elements remains a given distance away from the base strip of the other element with hooks.

11. The device according to claim 10, characterized in that the ratio of the given distance to the height of the stem is between 10% and 70%.

12. The device of claim 10, wherein, characterized in that the ratio of the given distance to the height of the stem is between 20% and 50%.

13. The device according to claim 1, characterized in that the two elements with hooks each comprise a base strip and hooks extending from the respective base strip, each element with hooks comprising a part forming a stem and a part forming a head that protrudes laterally from the part forming the stem and, when the bag is closed, an uppermost point of the each hook of one of the elements with hooks remains a distance away from the base strip of the other element with hooks, and vice versa.

14. The device according to claim 1, characterized in that the hooks of at least one of the two elements with hooks, are arranged in a plurality of rows, and the distance between two adjacent hooks along a row is greater than or equal to the respective dimension of the hooks measured along said row.

15. The device of claim 14, characterized in that the hooks of both of the two elements with hooks are arranged in a plurality of rows, and the distance between two adjacent hooks along a row is greater than or equal to the respective dimension of the hooks measured along said row.

16. The device according to claim 1, characterized in that the first local maximum (B) is between 10 N and 35 N.

17. The device according to claim 16, characterized in that the first local maximum (B) is between 15 N and 25 N.

18. The device according to claim 1, characterized in that a "click" coefficient equal to the ratio of the square of the value of a force at point B to a value of the projection of the segment AB over a horizontal axis is between 100 and 500 $N^2$/mm.

19. The device of claim 18, wherein the "click" coefficient equal to the ratio of the square of the value of the force at point B to the value of the projection of the segment AB over the horizontal axis is between 150 and 500 $N^2$/mm.

* * * * *